US008020541B2

(12) United States Patent
Nelander et al.

(10) Patent No.: US 8,020,541 B2
(45) Date of Patent: Sep. 20, 2011

(54) POSITIVE CRANKCASE VENTILATION SYSTEM

(75) Inventors: Christopher Paul Nelander, West Bloomfield, MI (US); John N. Stockbridge, Novi, MI (US); Todar Kuzmanov, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 73 days.

(21) Appl. No.: 12/638,301

(22) Filed: Dec. 15, 2009

(65) Prior Publication Data

US 2011/0139098 A1 Jun. 16, 2011

(51) Int. Cl.
*F02M 35/10* (2006.01)

(52) U.S. Cl. ..... 123/572; 123/184.21

(58) Field of Classification Search ..... 123/572–574, 123/184.21–184.61
See application file for complete search history.

(56) References Cited

U.S. PATENT DOCUMENTS

| | | | | |
|---|---|---|---|---|
| 5,209,191 | A | 5/1993 | Kopec | |
| 6,192,848 | B1 * | 2/2001 | Hada et al. | 123/184.24 |
| 6,234,154 | B1 | 5/2001 | Spix | |
| 6,679,228 | B1 * | 1/2004 | Confer et al. | 123/516 |
| 6,807,957 | B2 | 10/2004 | Ko | |
| 7,827,973 | B2 * | 11/2010 | Vichinsky | 123/572 |
| 2005/0076892 | A1 * | 4/2005 | Nakamura et al. | 123/572 |
| 2006/0005820 | A1 * | 1/2006 | Jeon | 123/572 |
| 2010/0037870 | A1 * | 2/2010 | Elz et al. | 123/559.1 |

* cited by examiner

*Primary Examiner* — M. McMahon
(74) *Attorney, Agent, or Firm* — Cantor Colburn LLP

(57) ABSTRACT

A positive crankcase ventilation system for an internal combustion engine comprises an intake manifold having a plurality of intake runners configured to deliver combustion air to the internal combustion engine. An intake manifold positive crankcase ventilation passage is disposed in the intake manifold and is in fluid communication with a source of blow-by gas from the engine. A positive crankcase ventilation distribution channel is formed adjacent to the sealing face of the intake manifold and a modular positive crankcase ventilation distribution conduit assembly is disposed in the positive crankcase ventilation distribution channel and extends from the positive crankcase ventilation passage to the plurality of intake runners for delivery of the blow-by gas thereto.

12 Claims, 3 Drawing Sheets

POSITIVE CRANKCASE VENTILATION SYSTEM

FIELD OF THE INVENTION

Exemplary embodiments of the present invention are related to a positive crankcase ventilation system for an internal combustion engine.

BACKGROUND

During engine operation, combustion gas may bypass the cylinder/piston ring interface and enter the engine crankcase. The leaked combustion gas is referred to as blow-by gas and may comprise portions of unburned intake air/fuel mixture, exhaust gas, oil mist, water vapor or a combination thereof. Unless removed, the blow-by gas may increase the pressure in the crankcase which can damage seals and lead to reduced engine performance. In addition, due to the constituents in the blow-by gas, contamination of the engine oil is likely unless the gas is evacuated. Evacuation of the blow-by gas from the crankcase to the intake system of the internal combustion engine is desirable in order to prevent the release of the unburned gas to the atmosphere.

Positive crankcase ventilation (PCV) systems are typically employed to ventilate the crankcase and to re-introduce the blow-by gas to the intake system of the internal combustion engine for burning in the combustion chambers. The PCV system takes advantage of the negative pressure in the engine intake system to draw the blow-by gas out of the crankcase.

As a result of packaging concerns, as well as environmental effects on PCV systems which are disposed externally of the engine cylinder block, PCV systems have been incorporated internally of the engine block and cylinder head castings to minimize the risk of freezing during cold weather applications of the engine (blow-by gases may contain a high percentage of water vapor) and to assist in the packaging of the engine, especially in vehicular applications. A challenge for engine designers is determining how to evenly distribute the blow-by gas to each engine cylinder so as to minimize the negative effects of the gas on combustion. Introduction of the blow-by gas in close proximity to the throttle body has been one solution however due to the constituents of the gas, negative affects on the operation of throttle body components have been observed. Such systems lack flexibility especially when modifications such as tuning valves and the like are introduced into the intake manifold.

SUMMARY OF THE INVENTION

In an exemplary embodiment of the invention, a positive crankcase ventilation system for an internal combustion engine comprises an intake manifold having a sealing face for mounting to a portion of the internal combustion engine. A plurality of intake runners extend through the intake manifold and are configured to deliver combustion air to the internal combustion engine. An intake manifold positive crankcase ventilation passage is disposed in the intake manifold and is in fluid communication with a source of blow-by gas from the engine. A positive crankcase ventilation distribution channel is formed adjacent to the sealing face of the intake manifold and a positive crankcase ventilation distribution conduit assembly is disposed in the positive crankcase ventilation distribution channel and extends from the positive crankcase ventilation passage to the plurality of intake runners for delivery of the blow-by gas thereto.

In another exemplary embodiment of the invention, an internal combustion engine having a positive crankcase ventilation system comprises an engine block having a crankcase portion, a cylinder head, having an intake side, mounted on top of the engine and an intake manifold having a sealing face mounted to the intake side of the cylinder head and having a plurality of intake runners extending therethrough for delivery of combustion air to intake ports in the cylinder head. A positive crankcase ventilation passage extends from the crankcase portion of the cylinder block to an intake manifold positive crankcase ventilation passage for delivery of blow-by gas to the intake manifold. A positive crankcase ventilation distribution channel is formed adjacent to the sealing face of the intake manifold and a positive crankcase ventilation distribution conduit assembly is disposed in the positive crankcase ventilation distribution channel and extends from the intake manifold positive crankcase ventilation passage to the plurality of intake runners for delivery of blow-by gas thereto.

The above features and advantages and other features and advantages of the present invention are readily apparent from the following detailed description of the best modes for carrying out the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

Figure 1:
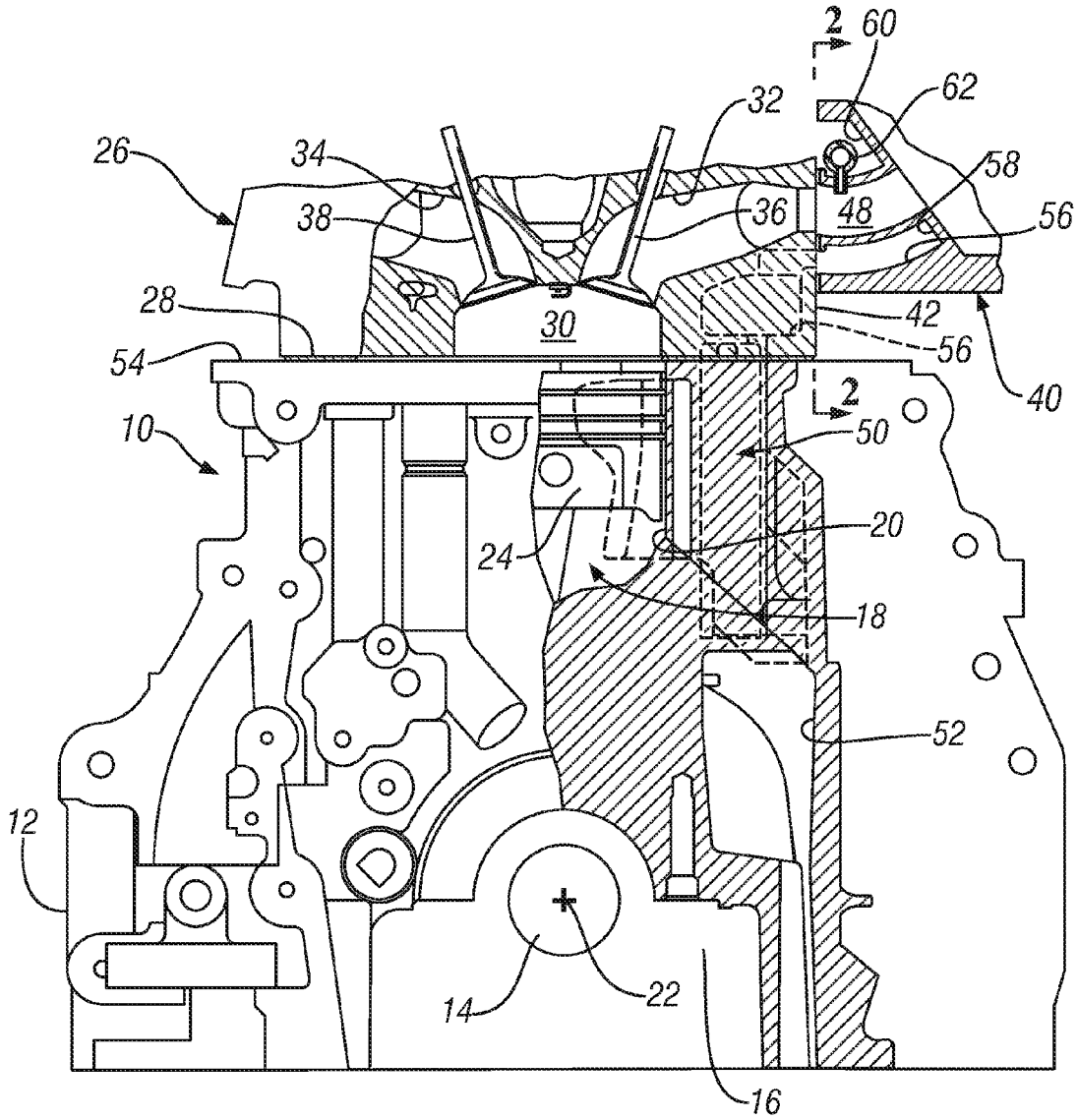
FIG. 1 is a partial sectional view of an internal combustion engine embodying aspects of the present invention.

The following description is merely exemplary in nature and is not intended to limit the present disclosure, application or uses. It should be understood that throughout the drawings, corresponding reference numerals indicate like or corresponding parts and features.

FIG. 1 illustrates a portion of an internal combustion engine 10 that includes an engine block 12 having a crankshaft 14 housed for rotation in a crankcase portion 16 of the engine block 12. Cylinders 18 defined by cylinder walls 20 are arranged in series along the longitudinal axis 22 of the engine block 12. Each cylinder 18 houses a piston 24 for reciprocation therein during operation of the internal combustion engine 10. A cylinder head 26 is mounted to the top of the engine block 12 with a head gasket 28 interposed therebetween. The cylinder head 26 closes each cylinder 18 and cooperates with each piston 24 to form combustion chambers 30. Each combustion chamber 30 has at least one intake port 32 that is configured to deliver an air\fuel mixture to the combustion chamber 30 and at least one exhaust port 34 configured to remove combustion gas from the combustion chamber. An intake valve 36 is seated in the intake port 32 and an exhaust valve 38 is seated in the exhaust port 34 adjacent to each combustion chamber 30. An intake manifold 40 is mounted to the intake side 42 of the cylinder head 26 having a sealing flange 44, FIG. 2, disposed in or on the sealing face 45 thereof. The intake manifold may include an upstream throttle body (not shown) to meter combustion air to a plurality of intake runners 48 aligned with the intake ports 32 in the cylinder head 26.

During engine operation, the intake stroke of the piston 24 draws combustion air through the intake manifold 40 and intake ports 32 to the combustion chambers 30 of the internal combustion engine 10. Fuel is combined with the combustion air to create a combustible air/fuel mixture. The fuel may be added before or after the combustion air enters each combustion chamber 30 (i.e. port injection or direct injection fuel systems, for example). During the power stroke of the piston 24, a small portion of the combustion gas may pass by the interface between the piston and the cylinder wall 20 and into the crankcase portion 16 of the engine block 12. This combustion or "blow-by" gas may include corrosive exhaust gas, unburned air/fuel mixture, oil mist, water vapor or a combination thereof. A positive crankcase ventilation ("PCV") system, designated generally as 50, is configured to ventilate the crankcase portion 16 of the engine block 12 and to re-circulate the blow-by gas to the intake side of the internal combustion engine 10 for reintroduction to and burning in the combustion chambers 30.

In an exemplary embodiment, the PCV system 50 includes an engine block positive crankcase ventilation passage 52 ("engine block PCV passage") that extends from the crankcase portion 16 of the engine block 12 to and upper face 54 of the engine block 12 where it defines an opening therein. A cylinder head positive crankcase ventilation passage 54 ("cylinder head PCV passage") is integrally formed in the cylinder head 26 and fluidly connects with the engine block PCV passage 52 for receipt of blow-by gas therefrom. The cylinder head PCV passage 54 extends through the cylinder head 26 to the intake side 42 thereof where it defines an opening therein.

Figure 2:
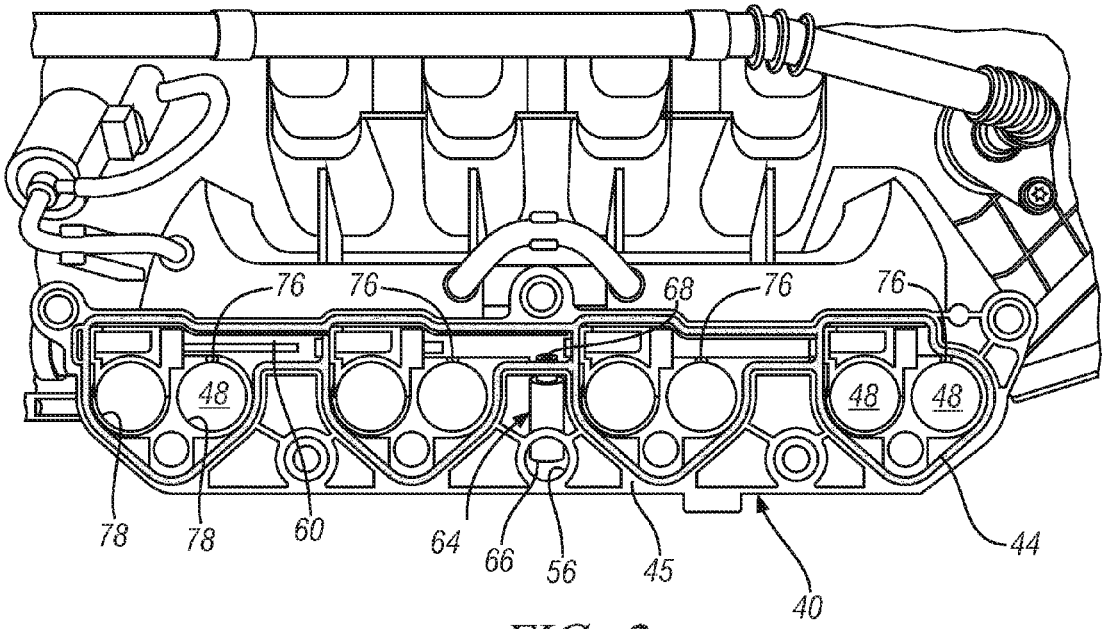
FIG. 2 is a plan view of the sealing face of the intake manifold of the engine illustrated in FIG. 1, taken at section 2-2.
Figure 3:
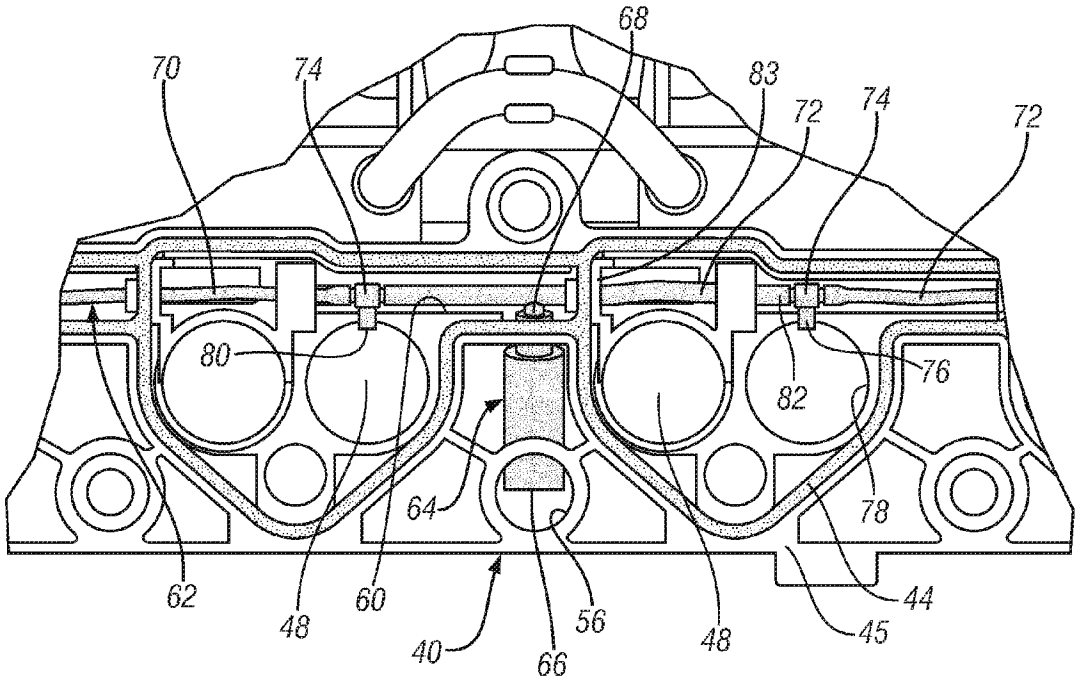
FIG. 3 is an enlarged view of a portion of FIG. 2.

Referring additionally to FIGS. 2 and 3, in an exemplary embodiment, the intake manifold 40 includes an intake manifold positive crankcase ventilation passage 56 ("intake manifold PCV passage") that opens through the sealing face 45 of the intake manifold 40 and terminates in a closed end. The intake manifold PCV passage 56 aligns with the cylinder head PCV passage 54 and receives blow-by gas when the intake manifold 40 is sealingly mounted to the intake side 42 of the cylinder head 26. A PCV distribution channel or groove 60 is integrally formed in the intake manifold 40 and is configured to receive a PCV distribution conduit assembly 62 therein. The PCV distribution conduit assembly 62 comprises a blow-by gas inlet conduit 64 having a first end 66 in fluid communication with the interior of the intake manifold PCV passage 56. A second end 68 of the blow-by gas inlet conduit 64 is in fluid communication with distribution conduit 70 that is disposed in the PCV distribution channel 60, FIG. 3, and extends axially along the length of the intake manifold 40.

Figure 4:
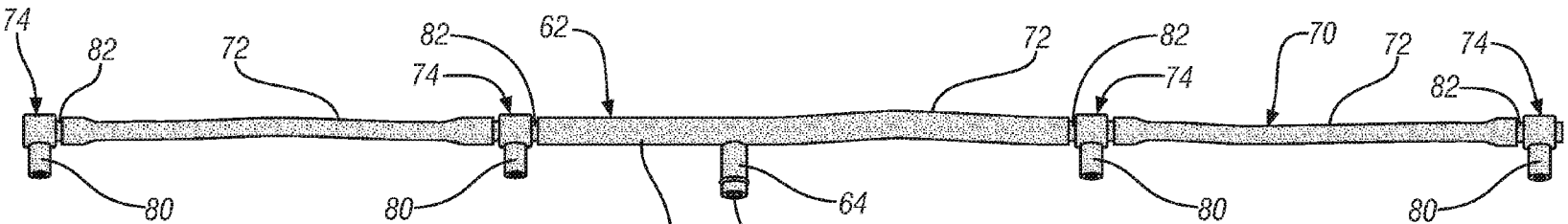
FIG. 4 is a perspective view of a PCV distribution conduit assembly embodying features of the present invention.

In one exemplary embodiment illustrated in FIGS. 3 and 4, the distribution conduit 70 comprises a series of flexible segments 72 that extend between, and fluidly connect the blow-by gas inlet conduit 64 to a plurality of positive crankcase ventilation nozzles ("PCV nozzles") 74 that are located at spaced intervals along the length thereof. The flexible segments 72 may be constructed of rubber, nylon or other tubing that has suitable, high temperature, high contaminant durability. In another embodiment, the segments 72 may be constructed of less flexible materials such as metal or rigid polymer. The PCV nozzles 74 may also be constructed of rigid plastic or metal and include nipples 82 that engage the ends of the flexible segments 72. The PCV nozzles 74 are configured to be received in nozzle slots 76, FIG. 2, that are formed in the walls 78 of the intake runners 48 of the intake manifold 40. The nozzle slots 76 extend inwardly from the sealing face 45 of the intake manifold 40 and position the nozzle outlets 80 in intake runners 48 for delivery of blow-by gas from the PCV system 50 to the combustion air flowing into the intake ports 32 of the cylinder head 26. Each PCV nozzle 74 may have similar flow characteristics through the nozzle outlets 80 or may be configured to customize or balance the flow of PCV blow-by gas delivered to the individual intake ports 32.

In an exemplary embodiment, during operation of the internal combustion engine 10, as combustion occurs in the cylinders 18 of the engine block 14, small amounts of the combustion constituents (blow-by gas) leak past the pistons 24 and into the crankcase portion 16 of the engine block. The blow-by gas enters and transits the PCV system 50 through the engine block PCV passage 52, the cylinder head PCV passage 54 and the intake manifold PCV passage 56. The intake manifold PCV passage 56 delivers the blow-by gas to the PCV distribution conduit assembly 62 disposed in the PCV distribution channel 60 of the intake manifold 40 through the blow-by gas inlet conduit 64. The blow-by gas flows through the PCV distribution conduit assembly 62 and exits the PCV system 50 through nozzle outlets 80 of the plurality of PCV nozzles 74 in fluid communication with the combustion air flowing into the intake ports 32 of the cylinder head 26.

The use of the modular PCV distribution conduit assembly 62, FIG. 4, provides for a simple "drop-in" assembly operation of the intake manifold 40 without the limitations of an integrated PCV flow path that limits modification of the intake manifold 40 and associated hardware. The addition of hardware to, or modification of, the intake manifold 40 at the sealing face 45 may necessitate only a lengthening of one or more flexible segments 72 allowing the segment to be moved or deflected into a different location or orientation in the PCV distribution channel 60. Obviously the use of rigid segments 72 will require a slightly higher degree of re-engineering. Additionally, location of the modular PCV distribution conduit assembly 62 within the intake manifold 40 adjacent to the sealing face 45 with the cylinder head 26 provides a ready source of heat from the cylinder head 62 that prevents freezing of moisture carried in the blow-by gas and potential failure of the PCV system 50. Once the PCV distribution conduit assembly 62 is installed in the PCV distribution channel 60, supporting inserts such as 83 may be assembled to bridge or span any regions of the channel that are required to support the sealing flange 44.

Figure 1A:
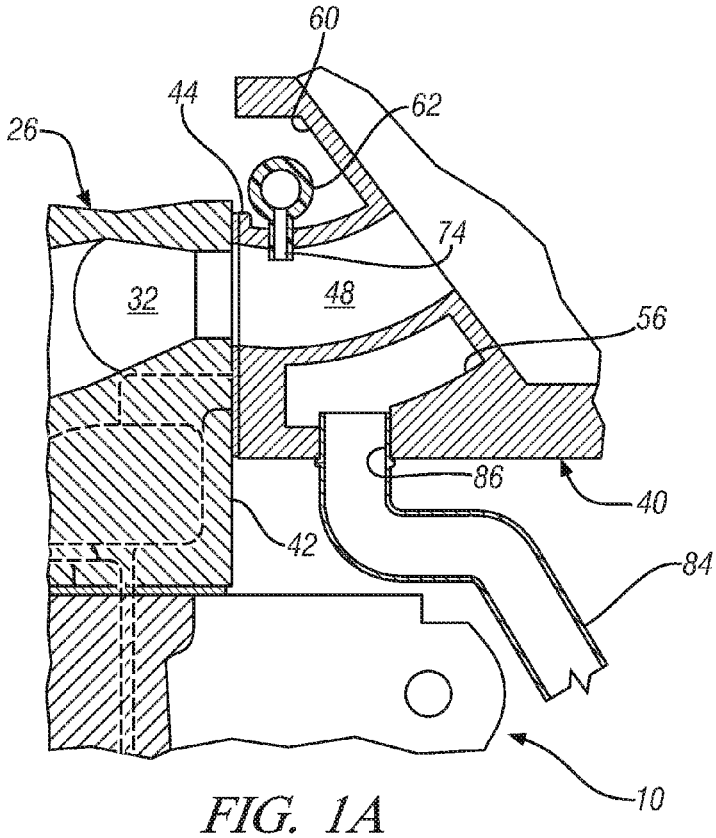
FIG. 1A is an enlarged portion of FIG. 1 illustrating another embodiment of the present invention.

While the description provided above has been primarily directed to the Figures which illustrate an internal combustion engine having four cylinders, it is contemplated the invention has equal application to virtually any engine configuration (ex. V-configured, inline or horizontally opposed,) having any number of cylinder as well as to spark or compression ignition, internal combustion engines. In addition, the internal combustion engine 10 described herein utilizes internal PCV passages that extend from the crank case portion 16 of the engine block 12 through the cylinder head 26 and to the intake manifold PCV passage 56. It is also contemplated that various aspects of the invention are equally applicable to internal combustion engines utilizing an external PCV conduit 84, shown in phantom in FIG. 1A, that fluidly connects the engine crank case portion 16 with the intake manifold PCV passage 56 through an opening 86 in a wall of the intake manifold 40.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

What is claimed is:

1. A positive crankcase ventilation system for an internal combustion engine comprising:

an intake manifold having a sealing face for mounting to a portion of the internal combustion engine;

a plurality of intake runners extending through the intake manifold and configured to deliver combustion air to the internal combustion engine;

a positive crankcase ventilation passage disposed in the intake manifold and in fluid communication with blow-by gas from the engine;

a positive crankcase ventilation distribution channel formed in the intake manifold adjacent to the sealing face thereof; and a positive crankcase ventilation distribution conduit assembly disposed in the positive crankcase ventilation distribution channel and extending from the positive crankcase ventilation passage to the plurality of intake runners for delivery of the blow-by gas thereto.

2. The positive crankcase ventilation system of claim 1, the positive crankcase ventilation distribution conduit assembly further comprising:

a blow-by gas inlet conduit having a first end in fluid communication with the positive crankcase ventilation passage and a second end in fluid communication with a distribution conduit; and a plurality of positive crankcase ventilation nozzles extending from the distribution conduit, at spaced intervals along a length thereof, and terminating in the plurality of intake runners for delivery of the blow-by gas thereto.

3. The positive crankcase ventilation system of claim 2, wherein the plurality of intake runners include nozzle slots for receiving nozzle outlets of the plurality of positive crankcase ventilation nozzles therein.

4. The positive crankcase ventilation system of claim 2, wherein the positive crankcase ventilation distribution conduit assembly further comprises:

a series of flexible segments that extend between, and fluidly connect the blow-by gas inlet conduit to the plurality of positive crankcase ventilation nozzles.

5. The positive crankcase ventilation system of claim 2, wherein the positive crankcase ventilation distribution conduit assembly is a modular assembly.

6. An internal combustion engine having a positive crankcase ventilation system comprising:

an engine block having a crankcase portion;

a cylinder head mounted on top of the engine and having an intake side;

an intake manifold having a sealing face mounted to the intake side of the cylinder head and having a plurality of intake runners extending therethrough for delivery of combustion air to intake ports in the cylinder head;

a positive crankcase ventilation passage extending from the crankcase portion of the cylinder block to an intake manifold positive crankcase ventilation passage for delivery of blow-by gas to the intake manifold;

a positive crankcase ventilation distribution channel formed in the intake manifold adjacent to the sealing face thereof; and a positive crankcase ventilation distribution conduit assembly disposed in the positive crankcase ventilation distribution channel and extending from the intake manifold positive crankcase ventilation passage to the plurality of intake runners for delivery of the blow-by gas thereto.

7. The internal combustion engine of claim 6, wherein the positive crankcase ventilation passage comprises:

an engine block positive crankcase ventilation passage extending from the crankcase portion of the engine block to an upper face thereof and to define an opening therethrough; and a cylinder head positive crankcase ventilation passage integrally formed in the cylinder head and in fluid communication with the engine block positive crankcase ventilation passage, for receipt of the blow-by gas therefrom, and extending through the cylinder head to the intake side thereof and to define an opening therethrough for delivery of the blow-by gas to the intake manifold positive crankcase ventilation passage.

8. The internal combustion engine of claim 6, wherein the positive crankcase ventilation passage comprises a conduit, extending externally of the engine block and the cylinder head, and fluidly connecting the engine crankcase portion and the positive crankcase ventilation passage through a side of the intake manifold.

9. The internal combustion engine of claim 6, wherein the positive crankcase ventilation distribution conduit assembly further comprises:

a blow-by gas inlet conduit having a first end in fluid communication with the positive crankcase ventilation passage and a second end in fluid communication with a distribution conduit; and a plurality of positive crankcase ventilation nozzles extending from the distribution conduit at spaced intervals along a length thereof and terminating in the plurality of intake runners for delivery of the blow-by gas thereto.

10. The internal combustion engine of claim 9, wherein the plurality of intake runners include nozzle slots for receiving nozzle outlets of the plurality of positive crankcase ventilation nozzles therein.

11. The internal combustion engine of claim 9, wherein the positive crankcase ventilation distribution conduit assembly further comprises:

a series of flexible segments that extend between, and fluidly connect the blow-by gas inlet to the plurality of positive crankcase ventilation nozzles.

12. The internal combustion engine of claim 9, wherein the positive crankcase ventilation distribution conduit assembly is configured as a modular assembly for installation into the intake manifold.

* * * * *